United States Patent [19]

Ueno

[11] 4,445,882

[45] May 1, 1984

[54] TAG ATTACHER

[75] Inventor: Hideyuki Ueno, Yokohama, Japan

[73] Assignees: Ben Clements & Sons, Inc., South Hackensack, N.J.; Toska Co., Ltd.; Japan Bano'k Co., Ltd., both of Tokyo, Japan

[21] Appl. No.: 327,160

[22] Filed: Dec. 3, 1981

[30] Foreign Application Priority Data

Dec. 10, 1980 [JP] Japan ..... 55-174188

[51] Int. Cl.[3] ..... B25C 1/00

[52] U.S. Cl. ..... 493/376; 227/67

[58] Field of Search ..... 493/376, 375; 227/67

[56] References Cited

U.S. PATENT DOCUMENTS

| | | | |
|---|---|---|---|
| 286,741 | 10/1883 | Smith, Jr. | 227/67 X |
| 567,505 | 9/1896 | Platt | 227/67 |
| 1,540,690 | 6/1925 | Friedman et al. | 493/376 X |
| 3,924,788 | 12/1975 | Furutu | 227/67 |
| 4,049,178 | 9/1977 | Strausburg | 227/67 |
| 4,090,653 | 5/1978 | Furutu | 227/67 |

FOREIGN PATENT DOCUMENTS

| | | | |
|---|---|---|---|
| 318590 | 6/1934 | Italy | 227/67 |

*Primary Examiner*—James F. Coan

*Attorney, Agent, or Firm*—Blum, Kaplan, Friedman, Silberman & Beran

[57] ABSTRACT

A device for attaching to an article a tag pin for use in affixing a price tag or the like thereto. This device consists of a side-slitted hollow needle provided at a front portion of an enclosure thereof, and a push rod provided at the rear side, and movable in the direction of the axis, of the hollow needle, the push rod being moved by a lever means so as to force a lateral rod of a tag pin into the hollow needle. A resilient member is provided between the push rod and the lever means adapted to drive the push rod.

19 Claims, 10 Drawing Figures

TAG ATTACHER

BACKGROUND OF THE INVENTION

1. Field of the Invention

This invention relates to an improvement in a tag attacher for use in affixing price tags or the like to articles, or putting a plurality of articles together, with tag pins.

2. Description of the Prior Art

A tag pin consists, as shown in FIG. 1, of a head portion H, a lateral rod B, and a filament F connecting the head portion H and lateral rod B together. A tag pin assembly t, which constitutes a unit of production of the tab pins, and which is generally in the shape of a comb, consists of a plurality of tag pins, and a connecting bar R, to which the tag pins are joined via connecting portions C extended in alignment with the filaments F and beyond the lateral rods B.

The tag pin assembly T is obtained by molding a linear macromolecular material, such as nylon and polypropylene.

In an ordinary method of manufacturing tag pin assemblies T, a metal mold is heated to a high temperature, and a high-temperature molten resin is injected therein. A tag pin assembly T obtained by this method is crystallized in its entirety. Therefore, the filaments F extended between the head portions H and lateral rods B can be subjected to molecular orientation by stretching the same. The filaments F thus stretched becomes tough and thin, and have firm connecting portions between the filaments F and lateral rods B. Accordingly, an operation for driving a tag pin into an article by a tag attacher to affix a price tag or the like thereto can be carried out easily. Moreover, since the filament of the tag pin is very thin, a textile material can be prevented from being damaged thereby.

However, the filament of a tag pin manufactured by the above-mentioned method is in an already-stretched state, so that the tag pin does not permit bundling a plurality of articles, for example, socks and gloves closely to one another.

Since the length of the filament of such a tag pin cannot be varied, it is necessary that tag pins of different lengths be prepared in accordance with the use thereof. This makes it necessary to prepare various sizes of metal molds, and the controlling of metal molds and products becomes complicated. As a result, the cost of manufacturing tag pin assemblies is necessarily increased.

The inventor of the present invention has made efforts to eliminate the above-mentioned drawbacks encountered in a conventional tag pin having an already-stretched filaments, and developed a tag pin having a filament capable of being stretched when the tag pin is driven into an article by a tag attacher. This tag pin can be obtained by non-crystallizing at least the filament thereof. Since this tag pin can be stretched at its filament when it is driven into an article by a tag attacher, the length thereof can be regulated arbitrarily. Accordingly, articles bundled with this tag pin are in a closely contacting state. In other words, this tag pin permits packaging articles in an excellent state. Furthermore, the present invention permits obtaining tag pins having a plurality of applications by using one kind of metal mold, so that the products can be controlled advantageously.

However, it has been discovered that loading the above-mentioned tag pin having a stretchable filament in a known tag attacher as disclosed in U.S. Pat. No. 3,924,788, and driving them into articles accompanies a serious trouble. The non-crystallized filament is advantageous in that it can be stretched at normal temperature and renders the use of a special heat-stretcher unnecessary but it is in an extremely delicate condition when it starts being stretched. When the filament starts being stretched, necking (narrowing) occurs therein, i.e. the cross-sectional area of a part of the filament is decreased suddenly. Such a cross section-reducing phenomenon occurs successively in the direction of the length of the filament. The results of the discussion of the stretching behavior of the filament show that, when the filament is drawn suddenly before necking has occurred therein, it is broken, but that, after necking has once occurred in the filament, it is not broken even when it is stretched at a considerably high rate.

In order to drive the above-mentioned tag pins into articles by using a conventional tag attacher as described in U.S. Pat. No. 3,924,788, they are subjected to the same method as already-stretched tag pins. This conventional tag attacher is shaped like a pistol, and so designed that, when a lever is gripped, the lateral rod of a tag pin is forced into a slitted needle. Since the lever-gripping speed is considerably high, the lateral rod of the tag pin is forced into the slitted needle at such a speed that is far higher than an optimum filament-stretching rate for causing necking to occur therein. Consequently, the breakage of filaments occurs frequently.

The inventor of the present invention, who discussed the filament-stretching rate with a view to eliminating the above-mentioned drawbacks encountered in the conventional tag attacher, discovered that, when the lever of the tag attacher is drawn in such a manner that the lateral rod of the tag pin is pressed initially lightly or with a small force and thereafter with a normal force, the filament is not substantially broken.

SUMMARY OF THE INVENTION

An object of the present invention is to provide a tag attacher, which is obtained on the basis of the above-mentioned discoveries and without greatly modifying the construction of a conventional tag attacher, and which permits reducing a tag pin-driving speed in a filament-stretching step.

To this end, the present invention provides a tag attacher characterized in that a resilient member is provided between a push rod for use in forcing a lateral rod of a tag pin into a slitted needle and a lever for use in driving the push rod.

The above and other objects of the invention will become apparent from the following description of the preferred embodiment.

DESCRIPTION OF THE PREFERRED EMBODIMENTS

Figure 1:
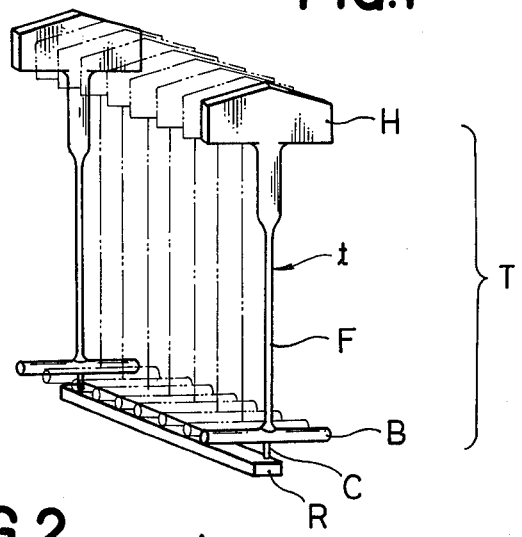
FIG. 1 is a perspective view of a tag pin assembly.
Figure 2:
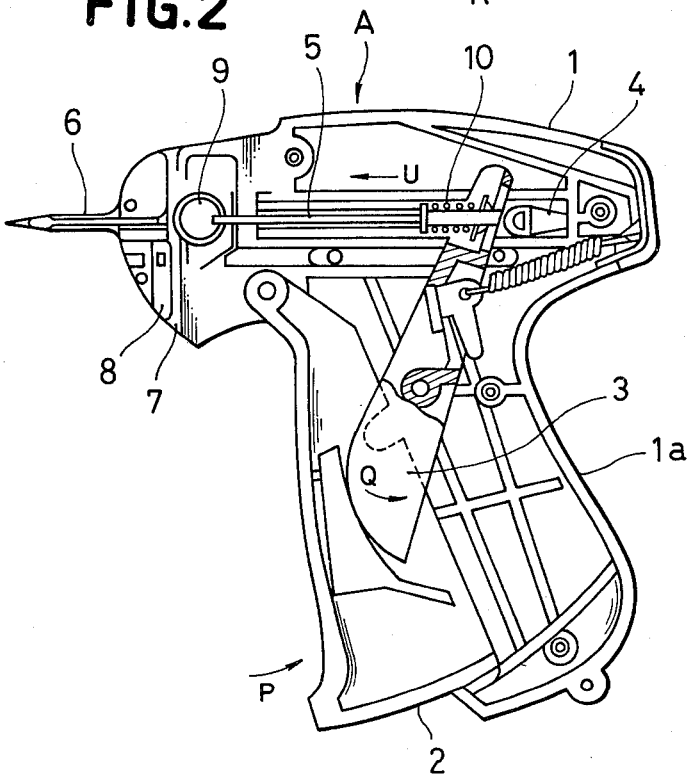
FIG. 2 is a side elevational view in section illustrating the construction of an inner portion of a tag pin attacher according to the present invention.

FIG. 2 is a front elevational view in section illustrating the construction of an inner portion of a tag attacher according to the present invention. A lever 2 is provided oscillatably at a grip 1*a* of a tag attacher body 1. The movement of the lever 2 is transmitted to an intermediate lever 3 and a slider 4 to move a push rod 5 toward a hollow needle 6 having a side slit, and thereby force into the hollow needle 6 a lateral rod of a tag pin positioned behind the same needle 6. Thus, the lateral rod of the tag pin is moved to the rear side of clothes through which the hollow needle is inserted. A price tag or the like is fixed to the clothes with the tag pin in this manner. A guide groove 7 is provided in a front portion of the body 1 of this tag attacher A. A connecting bar R of a tag pin assembly T shown in FIG. 1 is inserted into the guide groove 7. Every time a tag pin t has been driven into an article, the connecting bar R is displaced downwardly by a gear means 9 so as to successively position the lateral rod of the lowermost tag pin at an inlet of the hollow needle 6. When the lateral rod B of the tag pin t is forced into the hollow needle 6 by the push rod 5, a connecting portion C thereof is cut with a blade 8 to allow one tag pin t to be separated from the tag pin assembly T and driven into an article.

Figure 3:
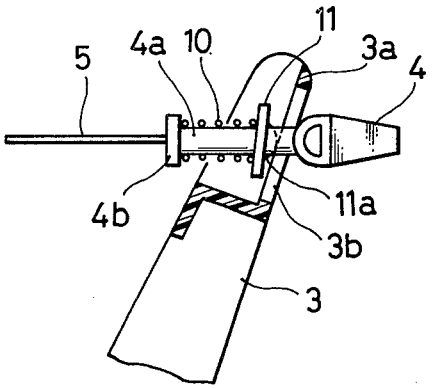
FIGS. 3A and 3B are side elevational view in section and front elevational view, respectively, of those portions of an intermediate lever and a slider which are engaged with each other.
Figure 3:
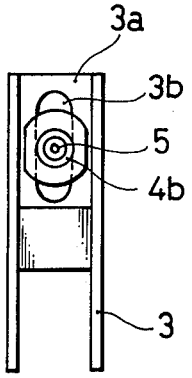
Figure 4:
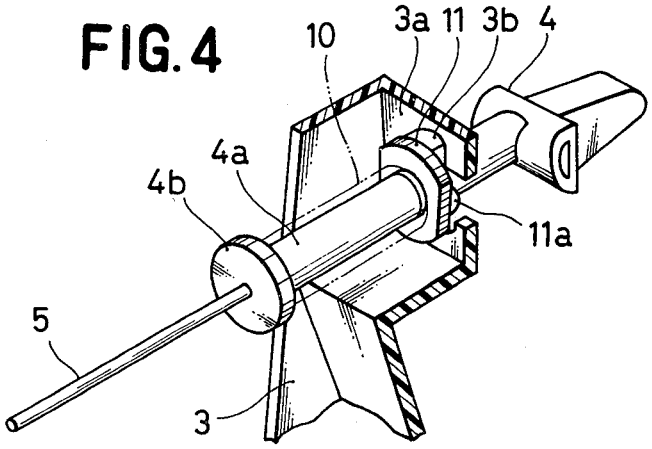
FIG. 4 is a partially cutaway view in perspective of those portions of the intermediate lever and slider which are shown in FIGS. 3A and 3B.

The present invention is characterized in that a spring 10 is provided between those portions of the intermediate lever 3 and slider 4 which are engaged with each other. As shown in FIGS. 3 and 4, the slider 4 has at a front portion thereof a push rod-holding member 4*a*, which is provided at a front end thereof with a flange 4*b*. The spring 10 is supported at one end thereof on the flange 4*b*, and at the other end thereof on a spring seat 11 fitted loosely around the push rod-holding member 4*a*.

The intermediate lever 3 is provided at an upper portion thereof with a receiver 3*a* for the spring seat 11. The receiver 3*a* is provided with a bore 3*b*, through which the push rod-holding member 4*a* is inserted. The rear end of the push rod-holding member 4*a* is moved vertically in the bore 3*b* in accordance with the oscillatory movements of the intermediate lever 3. A projection 11*a* of the spring seat 11 is moved slidingly in the vertical direction on those portions of the receiver 3*a* which are on both sides of the bore 3*b*, as the projection 11*a* is oscillated. Thus, the power from the intermediate lever 3 is transmitted to the spring 10 via the spring seat 11, and then to the push rod 5 via the slider 4. The projection 11*a* provided on the spring seat 11 serves as a means for oscillating the same spring seat 11 to transmit to the spring 10 accurately the power directed toward the push rod 5, and as a sliding block in a junction point with respect to the lever 3 in an oscillatory motion and push rod 5 in a linear reciprocating motion. The projection 11*a* is preferably such that can be moved on the receiver 3*a* as lightly as possible, and it may be provided with a miniaturized roller as necessary.

Figure 5:
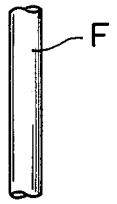
FIGS. 5A–5C illustrate various stages of a filament of a tag pin being stretched.
Figure 5:
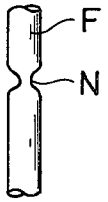
Figure 5:
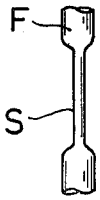

FIG. 5 is an enlarged view illustrating a filament F in various stages of a stretching operation therefor. FIG. 5A shows a filament F in an unstretched state, FIG. 5B the filament F starting being stretched with necking N occurring therein, and FIG. 5C the necking N stretched to a considerable extent with a stretched portion S occurring between the unstretched portions of the filament F. During this filament-stretching operation, a tensile force is applied to the filament in the direction of the length thereof, so that necking N or a local reduction of the cross-sectional area of the filament occurs momentarily. The stretching of the necking N then progresses to form a stretched portion S.

The characteristics of the present invention reside in the spring 10 provided between the push rod 5 and intermediate lever 3. When the lever 2 is gripped in the direction of an arrow P, the intermediate lever 3 is oscillated in the direction of an arrow Q, so that the slider 4 is moved in the direction of an arrow U. During this operation, the slider 4 continues to be moved in the mentioned direction until the push rod 5 has come into contact with the lateral rod B of that tag pin t which is positioned at an end portion of the hollow needle 6 having a side slit.

When the intermediate lever 3 is further oscillated in the direction of an arrow Q after the end portion of the push rod 5 has come into contact with the lateral rod B, the spring 10 begins to be compressed. The connecting portion of the tag pin referred to above is then cut with the blade 8, and the lateral rod B thereof is forced into the hollow needle 6 with the spring 10 compressed to some extent. At this time, the push rod 5 is moved at a low speed in spite of the oscillatory movement of the intermediate lever 3. During this operation of the tag attacher, the filament F is in the stretching starting state as shown in FIGS. 5A and 5B, in which necking N occurs as shown in FIG. 5B. The filament F is then further stretched as shown in FIG. 5C with the spring 10 further compressed to a greatly-contracted state, or with the force of the spring 10 exceeding the tension of the filament F.

Figure 6:
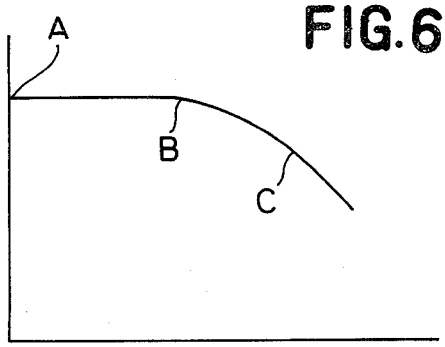
FIG. 6 is a graph showing the relation between a moving speed of a push rod and moving distance of the intermediate lever in the tag attacher according to the present invention.

FIG. 6 is a graph showing the relation between the moving speed (axis of ordinates) of the push rod 5 and the moving distance (axis of abscissas) of the intermediate lever 3. Referring to the drawing, that part of the curve which is between positions A, B represents the condition of the push rod 5 and intermediate lever 3 during such a period of time that is between an instant at which the intermediate lever 3 starts being oscillated and an instant at which the spring 10 starts being compressed. During this period of time, the push rod 5 is moved at a high speed in the direction of an arrow U, and the front end thereof comes into contact with the rear end of the lateral rod B of the tag pin t. When the intermediate lever 3 is then further oscillated in the direction of the arrow Q to cause the spring 10 to be compressed, the moving speed of the push rod 5 is reduced to a great extent as shown in a curve B–C as compared with that during the above-mentioned period of time corresponding to the curve A–B. During such a period of time that corresponds to the curve B–C, the tag pin t is separated from the tag pin assembly T and forced into the side-slitted hollow needle 6. The tag pin t is forced out from the front end of the hollow needle 6, and the head portion H thereof comes into contact with an article, such as clothes or the like. While the lateral rod B is forcibly moved through the hollow needle 6 by the push rod 5, the filament F is stretched as shown in FIG. 5.

The filament F requires to be stretched at such time that it is driven into an article. Accordingly, a tag pin used in the present invention is so designed that the filament F thereof has a length smaller than that of the filament F of an ordinary tag pin and can be stretched to a predetermined length.

During the time corresponding to the curve B–C in FIG. 6, the moving speed of the push rod 5 becomes low as previously mentioned, so that necking N occurs in the filament F as shown in FIG. 5B. The length of this narrowed portion is increased in the direction in which the tag pin advances, so that a stretched portion S shown in FIG. 5C is formed.

As described in detail above, the present invention is characterized in that the spring 10 is provided between the push rod 5 and a member for driving the push rod 5, in more detail, between those portions of the slider 4 for supporting the push rod 5 and the intermediate lever 3 which are engaged with each other. The spring 10 may be substituted by a bellows-like cushion formed by molding rubber or a synthetic resin. Therefore, according to the present invention, the lateral rod B of a tag pin can be prevented from receiving a large force suddenly when it is forced into the side-slitted needle 6. Namely, the lateral rod B is pressed gently when the filament F starts being stretched, so that necking N can be generated therein reliably.

During a short period of time in which necking N occurs in the filament F, or during a short period of time after necking N has occurred in the filament F, a low tensile force is applied to the filament F. Consequently, a stretched portion S (FIG. 5C) is formed smoothly without causing the filament F to be broken.

The spring 10 is most effectively provided on the slider 4, which is adapted to support the push rod 5, as in the above-described embodiment. The spring 10 may be substituted as necessary by an elastic member consisting of a rubber-like material and provided on a predetermined portion of the intermediate lever 3 in contact with the slider 4.

Figure 7:
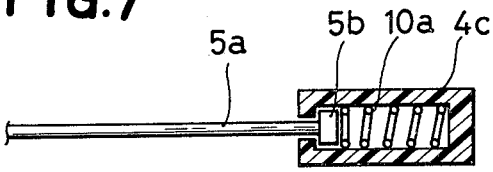
FIG. 7 is a side elevational view in section of another example of a slider provided with a buffer means therein.

FIG. 7 shows another embodiment of the present invention. In this embodiment, a piston 5*b* is provided at one end of a push rod 5*a* and housed in a cylinder 4*c*, which is a modification of the slider 4, and a spring 10*a* is provided in the cylinder 4*c* so as to urge the piston 5*b*. The operation and effect of this embodiment are the same as those of the previously-described embodiment.

What is claimed is:

1. A tag attacher for applying tag pins having a head portion, a body portion and a lateral rod base portion, said tag attacher comprising a tag attacher body, a longitudinally slitted hollow needle provided in a front portion of said tag attacher body, a push rod provided at the rear side of said hollow needle and capable of being moved in the direction of the axis of said hollow needle to thrust said lateral rod of a tag pin into, pass the same through, and force the same out of a front end of, said hollow needle, a movable lever for transmitting the force for moving said push rod, and a resilient member provided between said push rod and said lever, the resilient member being adapted to absorb a portion of the speed of moving of the lever after said push rod engages said tag pin and to, upon compression, apply the full speed of moving to said push rod.

2. A tag attacher according to claim 1, including a slider for transporting said push rod, said movable lever being an intermediate lever, said resilient member being provided between said intermediate lever and said slider.

3. A tag attacher according to claim 2, wherein said resilient member is supported at one end thereof on a flange provided at a front end of push rod-holding member formed at a front end portion of said slider, and at the other end thereof on a spring seat fitted loosely around said push rod-holding member.

4. A tag attacher according to claim 3, wherein said intermediate lever is provided at an upper portion thereof with a receiver for said spring seat, said receiver being provided with a bore through which said push rod-holding member is inserted, the rear end of said push rod-holding member being moved vertically in said bore in accordance with the oscillatory movements of said intermediate lever.

5. A tag attacher according to claim 3 or 4, wherein said spring seat is provided with a projection adapted to be moved oscillatorily and slidingly in the vertical direction on those portions of said receiver which are on both sides of said bore in accordance with the oscillatory movements of said intermediate lever.

6. A tag attacher according to claim 5, wherein said projection is provided with a miniaturized roller.

7. A tag attacher according to claim 1 or 2, wherein said resilient member comprises a spring.

8. A tag attacher according to claim 2, wherein that portion of said intermediate lever which is in contact with said slider is provided with a resilient member comprising a rubber-like material.

9. A tag attacher according to claim 2, wherein said portions of said intermediate lever and said slider comprise a cylinder housing having therein a piston provided at one of a push rod and a spring urging said piston.

10. A tag attacher according to claim 1, wherein said resilient member comprises a bellows-like cushion formed from molded rubber or a synthetic resin.

11. A tag attacher for applying and stretching tag pins having a head portion, a stretchable body portion and a lateral rod base portion, said tag attacher comprising a tag attaching body; a longitudinally slitted hollow needle provided in a front portion of said tag attaching body; a push rod provided at the rear side of said hollow needle capable of being moved in the direction of the axis of said hollow needle to thrust said lateral rod of said tag pin into, pass the same through, and force the same out of the front end of, said hollow needle while stretching said tag pin body portion; a movable lever for transmitting the force for moving said push rod; and a resilient member provided between said push rod and said lever, the resilient member being adapted to absorb a portion of the speed of moving of the lever after said push rod engages said tag pin and to, upon compression, apply said full speed of moving to said push rod, whereby the speed of initial stretching of the tag pin body portion is reduced to insure necking of said tag pin body portion.

12. A tag attacher according to claim 11, including a slider for transporting said push rod, said movable lever being an intermediate lever, said resilient member being provided between said intermediate lever and said slider.

13. A tag attacher according to claim 12, wherein said resilient member is supported at one end thereof on a flange provided at a front end of a push rod-holding member formed at a front end portion of said slider, and at the other end thereof on a spring seat fitted loosely around said push rod-holding member.

14. A tag attacher according to claim 11, wherein said resilient member comprises a spring.

15. A tag attacher according to claim 11, wherein said resilient member comprises a bellows-like cushion formed from molded rubber or a synthetic resin.

16. A tag attacher for applying tag pins having a head portion, a body portion and a lateral rod base portion, said tag attacher comprising a tag attacher body; a slitted hollow needle provided in a front portion of said tag attacher body; a push rod provided at the rear side of said hollow needle and capable of being moved in the direction of the axis of said hollow needle to thrust said rod of said tag pin into, pass the same through, and force the same out of a front end of, said hollow needle; a slider for supporting said push rod; an intermediate lever coupled to said slider for displacement thereof; and a resilient member provided between said push rod and said intermediate lever for coupling said slider and intermediate member.

17. A tag attacher according to claim 16, wherein said resilient member is supported at one end thereof on a flange provided at a front end of a push rod-holding member formed at a front end portion of said slider, and at the other end thereof on a spring seat fitted loosely around said push rod-holding member.

18. A tag attacher according to claim 17, wherein said resilient member comprises a spring.

19. A tag attacher according to claim 17, wherein said resilient member comprises a bellows-like cushion formed by molded rubber or a synthetic resin.

* * * * *